US006366275B1

(12) United States Patent
Lai

(10) Patent No.: US 6,366,275 B1
(45) Date of Patent: Apr. 2, 2002

(54) PUSH BUTTON STRUCTURE OF KEYBOARD

(75) Inventor: Kou-Yen Lai, No. 28-3, Alley 27, Lane 127, Nan-Shan Road, Chungho City, Taipei (TW)

(73) Assignees: Behavior Tech Computer Corporation; Kou-Yen Lai, both of Taipei (TW)

( * ) Notice: Subject to any disclaimer, the term of this patent is extended or adjusted under 35 U.S.C. 154(b) by 0 days.

(21) Appl. No.: 09/488,852

(22) Filed: Jan. 21, 2000

(51) Int. Cl.[7] ..... G09G 5/00
(52) U.S. Cl. ..... 345/168; 200/344; 200/517
(58) Field of Search ..... 345/168; 200/344, 200/517

(56) References Cited

U.S. PATENT DOCUMENTS 5,463,195 A * 10/1995 Watanabe et al. ..... 200/5
5,743,383 A * 4/1998 Yano et al. ..... 200/344
6,068,416 A * 5/2000 Kumamoto et al. ..... 400/491
6,080,948 A * 6/2000 Hong ..... 200/344

* cited by examiner

*Primary Examiner*—Richard Hjerpe
*Assistant Examiner*—Jean Lesperance
(74) *Attorney, Agent, or Firm*—Rosenberg, Klein & Lee

(57) ABSTRACT

A push button of a keyboard includes a cap movably supported on a base plate by two link members which are pivotally attached to each other and pivotally attached to both the cap and the base plate. A rubber cone is arranged between the cap and the base plate whereby when the cap is depressed, the rubber cone is deformed to trigger a switching circuit for generating a signal associated with the depression of the push button. Pairs of projections are formed on the cap defining a gap between each pair for rotatably accommodating upper pivot pins of the link members. Each projection forms an inclined face opposing each other for guiding and facilitating insertion of the upper pivot pins therein. Tabs are stamped on the base plate and define spaces for rotatably accommodating lower pivot pins of the link members. The tabs form inclined edges for guiding and facilitating insertion of the lower pivot pins into the spaces thereof. One of the link members forms a central pivot which is rotatably received in a bore defined in the other link member. The bore has a diverging side opening for guiding and facilitating insertion of the central pivot into the bore thereby enhancing assembly of the push button.

11 Claims, 4 Drawing Sheets

PUSH BUTTON STRUCTURE OF KEYBOARD

FIELD OF THE INVENTION

The present invention generally relates to a keyboard, and in particular to the structure of a key or push button of the keyboard which allows efficient assembly and smooth movement of the push button.

BACKGROUND OF THE INVENTION

Computer keyboards are a commonly used computer input device. A computer keyboard usually comprises a plurality of keys or push buttons arranged on a base. The push buttons are movably supported on the keyboard base whereby when the push buttons are struck and depressed, signals associated therewith are generated by a circuit and transmitted to a computer.

A conventional keyboard push button comprises a cap with a post extending downward therefrom. The post is axially and movably received in a bore defined in a base of the keyboard. The axial movement of the post may be adversely interfered with by non-perfect alignment of the post with the bore and tolerance thereof which cause jamming of the post and unstable movement of the cap. Also, noise caused by the unstable movement of the post and cap is a problem for the operation of the keyboard.

Furthermore, size reduction is a trend for the computer art. The conventional structure of a keyboard push button requires a post extending from a cap hindering reduction of the overall height of the keyboard.

A scissors-like double link mechanism is available in the market which comprises two link members pivoted to each other in a scissors-like manner for supporting a cap of a keyboard push button on a base of the keyboard. The scissors-like mechanism effectively solves the above problems. However, such a scissors-like mechanism requires pivotally attaching two link members together and mounting the links to both the cap and the base. This complicates assembly operation of keyboards.

Thus, it is desired to provide a push button structure of a keyboard having a scissors-like cap supporting mechanism which overcomes the problems encountered in the prior art.

SUMMARY OF THE INVENTION

Accordingly, an object of the present invention is to provide a push button structure of a keyboard which allows ready assembly thereof.

Another object of the present invention is to provide a push button structure of a keyboard which allows a smooth movement of the push button.

A further object of the present invention is to provide a push button structure of a keyboard which allows reduction of an overall height of the keyboard.

To achieve the above objects, in accordance with the present invention, there is provided a push button structure of a keyboard comprising a cap movably supported on a base plate by two link members which are pivotally attached to each other and pivotally attached to both the cap and the base plate. A rubber cone is arranged between the cap and the base plate whereby when the cap is depressed, the rubber cone is deformed to trigger a switching circuit for generating a signal associated with the depression of the push button. Pairs of projections are formed on the cap defining a gap between each pair for rotatably accommodating upper pivot pins of the link members. Each projection forms an inclined face opposing each other for guiding and facilitating insertion of the upper pivot pins therein. Tabs are stamped on the base plate and define spaces for rotatably accommodating lower pivot pins of the link members. The tabs form inclined edges for guiding and facilitating insertion of the lower pivot pins into the spaces thereof. One of the link members forms a central pivot which is rotatably received in a bore defined in the other link member. The bore has a diverging side opening for guiding and facilitating insertion of the central pivot into the bore thereby enhancing assembly of the push button.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
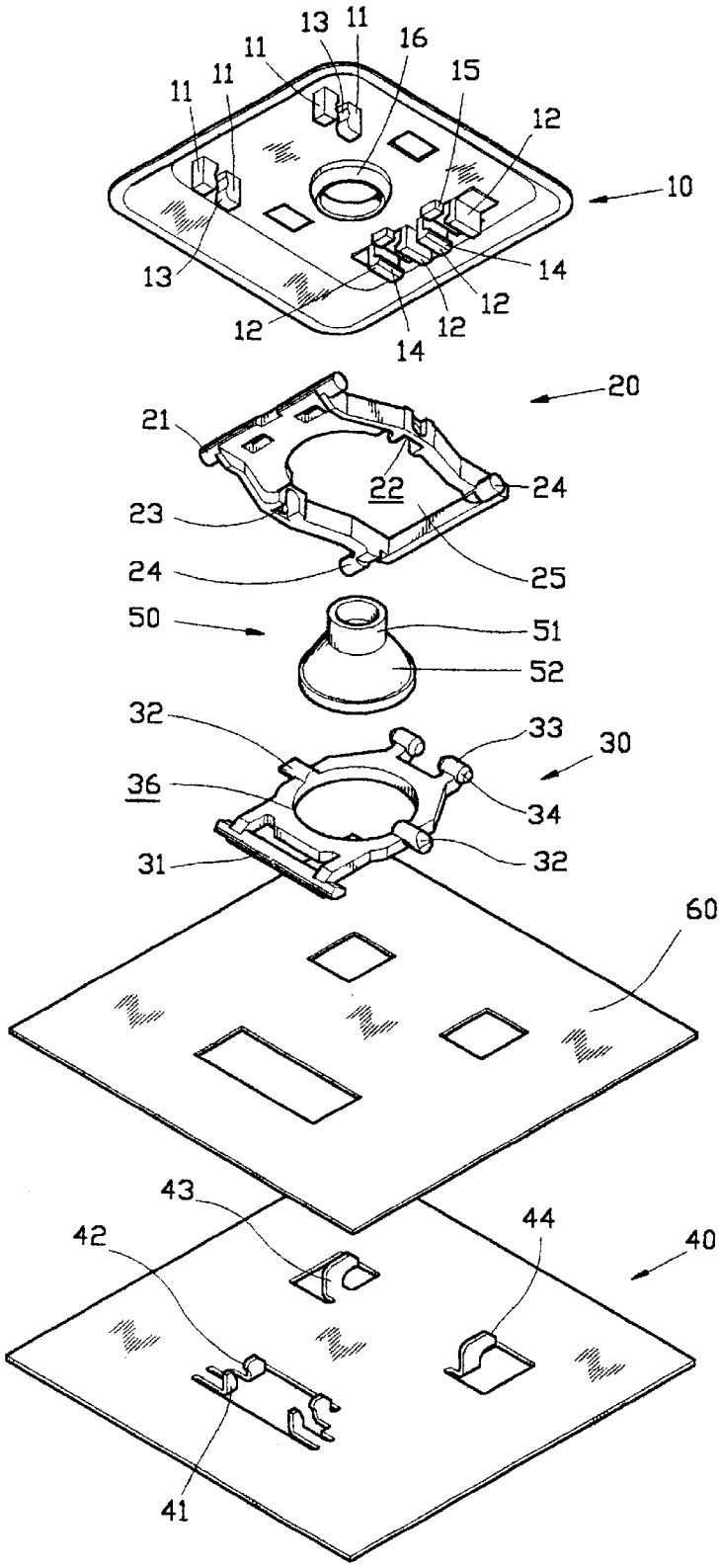
FIG. 1 is an exploded view of a push button of a computer keyboard in accordance with the present invention.
Figure 2:
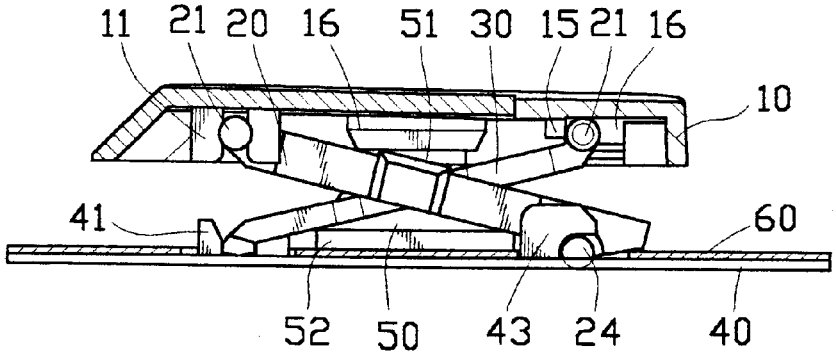
FIG. 2 is a side elevational view of the push button with a cap thereof being partially cut away for showing inside details.
Figure 3:
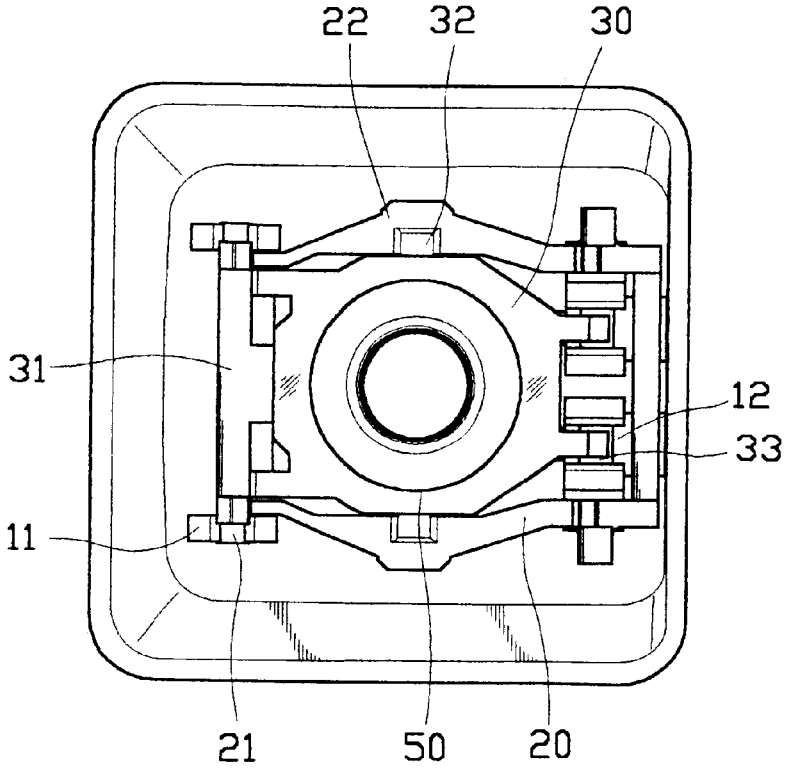
FIG. 3 is a bottom view of the push button with a base thereof removed.

With reference to the drawings and in particular to FIGS. 1–3, a push button of a keyboard in accordance with the present invention comprises a cap 10 spaced from and movably supported on a base plate 40 by first and second link members 20, 30 for being manually driven to deform a resilient cone 50 disposed between the cap 10 and the base 40 thereby activating a switching circuit 60 arranged between the base 40 and the link members 20, 30 to generate a signal.

The cap 10 forms two first pivot holders 11 defining aligned first bores. Each first pivot holder 11 is defined by two spaced bars extending from the cap 10. Each bar defines a central recess opposing each other to form the first bore. Preferably, each bar forms an inclined face 13 opposing each other. The cap 10 also forms two second pivot holders 12 each defining a second bore spaced from the first bore. Each second pivot holder 12 is defined by two spaced walls extending from the cap 10 with the second bore formed therebetween. Preferably, each wall forms an inclined face 14 opposing each other. A retaining block 15 is formed on the cap 10 and is arranged adjacent the second bore of each second pivot holder 12.

The first link member 20 is made as a rectangular frame having upper and lower sections connected by two opposite side sections forming a central passage 25 therebetween. Two aligned first upper pivot pins 21 are formed on and extend in opposite directions from the upper section of the first link member 20 and are rotatably received in the first bores of the first pivot holders 11. The inclined faces 13 of the bars of each first pivot holder 11 guide and facilitate insertion of the first upper pivot pin 21 into the first bore thereof. The firs link member 20 also forms two aligned first lower pivot pins 24 on the bottom section thereof. The first lower pivot pins 24 extend in opposite directions from the bottom section of the first link member 20.

The second link member 30 is made as a rectangular frame having upper and lower sections connected by opposite side sections forming a central passage 36 therebetween. The second link member 20 is sized to be received in the central passage 25 of the first link member 20. Two aligned central pivots 32 are formed on and extend in opposite directions from the side sections of the second link member 30. Preferably, the central pivots 32 are substantially centered between the upper and lower sections of the second link member 30 and each forming an inclination 35 at a free end thereof. The central pivots 32 are rotatably received in corresponding central bores 22 defined in the side sections of the first link member 20 thereby rendering the link members 20, 30 rotatable with respect to each other about the central pivots 32. Preferably, each central bore 22 of the first link member 20 has a diverging side opening 23 for guiding and facilitating insertion of the central pivots 32 of the second link member 30 therein.

The second link member 30 forms two second upper pivot pins 33 extending in opposite direction from the upper section thereof for being rotatably received in the second bores of the second pivot holders 12 of the cap 10. Preferably, each second upper pivot pin 33 has an inclination 34 which cooperates with the inclined face 14 of the corresponding second bore of the cap 10 for guiding and facilitating insertion of the second upper pivot pin 33 into the second bore of the corresponding second pivot holder 12. The retaining blocks 15 of the cap 10 retain the second upper pivot pins 33 inside the corresponding second pivot holders 12. The second link member 30 also forms a pair of second lower pivot pins 31 extending in opposite directions from the bottom section of the second link member 30.

The base plate 40 forms a pair of third pivot holders 43 each defining aligned third bores for rotatably receiving the first lower pivot pins 24 of the first link member 20. In the embodiment illustrated, each third pivot holder 43 is formed by an L-shaped tab stamped on the base plate 40. The L-shaped tab defines a recess serving as the third bore. Preferably, an inclination 44 is formed on each L-shaped tab for guiding and facilitating insertion of the first lower pivot pin 24 of the first link member 20 into the bore thereof.

The base plate 40 also forms a pair of fourth pivot holders 41 defining aligned fourth bores spaced from the third bores for rotatably receiving second lower pivot pins 31 of the second link member 30 therein. In the embodiment illustrated, each fourth pivot holder 41 is formed by two spaced tabs stamped from the base plate 40 with the fourth bore formed between the spaced tabs. A neck is formed between the tabs for retaining the second lower pivot pin 31. Preferably, each tab has an inclined edge 42 for guiding and facilitating insertion of the corresponding second lower pivot pin 31 into the bore thereof.

The resilient cone 50 comprises a conic body 52 having a reduced top section 51. The conic body 52 is arranged within the central passages 25, 36 of the first and second link members 20, 30 with the reduced section 51 received and retained in a recess 16 defined in the cap 10. The cap 10 is supported by the cone 50 whereby when the cap 10 is depressed, the cone 50 is deformed causing the first and second link members 20, 30 to rotate with respect to each other for allowing the cap 10 to move toward the base plate 40. The deformation of the resilient cone 50 transmits the force to a switching element (not shown) of the circuit 60 to generate a signal indicating the actuation of the push button.

Although the first and second link members 20, 30 are formed as rectangular frames in the embodiment illustrated, it is apparent to those skilled in the art that the rectangular frames may be replaced with U-shaped frames. In other words, the upper and lower sections of each link member 20, 30 may be connected to each other by only one side section. The essence of the present invention is to provide a scissors-like configuration for smoothly guiding the movement of the cap and reducing the overall height required for the keyboard and forming ready and efficient connection between the link members and the cap and base plates for prompting assembly and smoothening operation of the push button.

Figure 4:
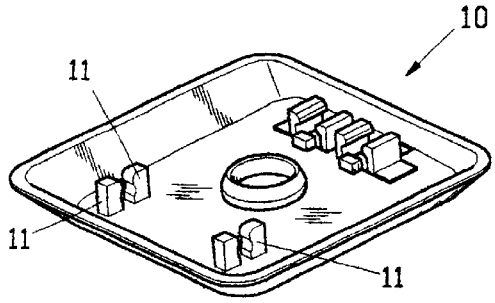
FIGS. 4–11 are side elevational views showing in sequence the assembly of the push button of the present invention.
Figure 5:
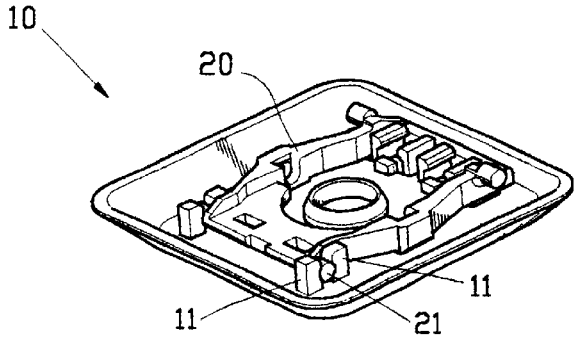
Figure 6:
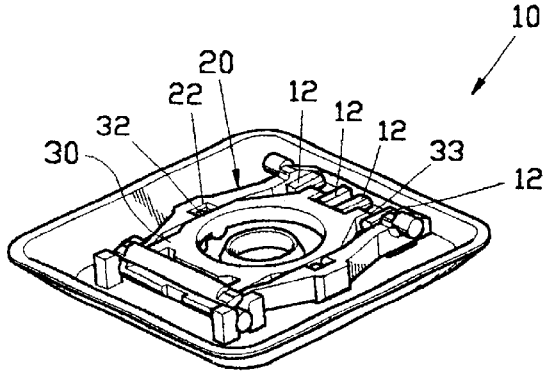
Figure 7:
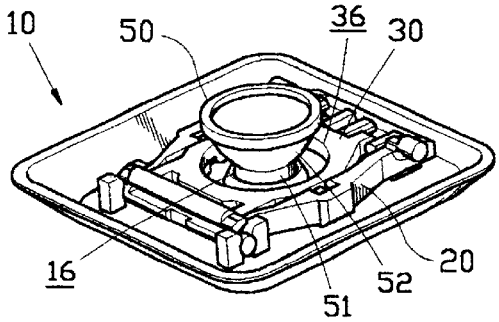
Figure 8:
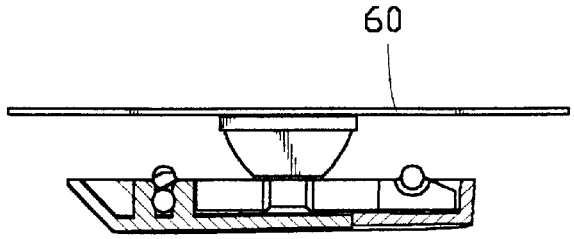
Figure 9:
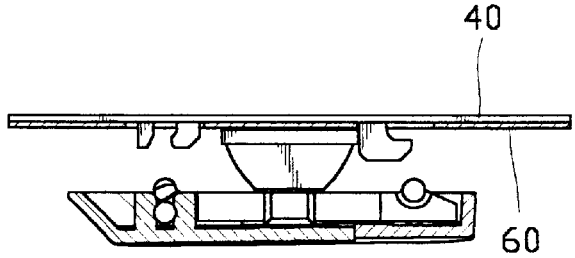
Figure 10:
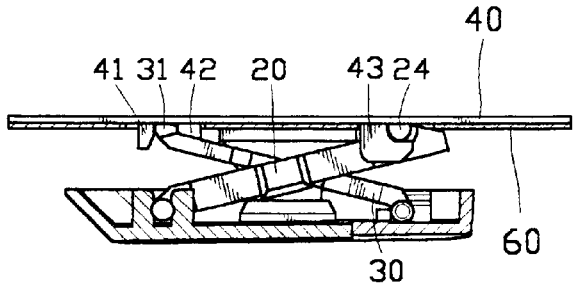
Figure 11:
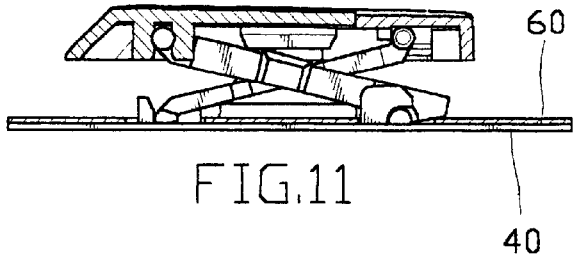

FIGS. 4–11 sequentially shows the assembly process of the push button. The cap 10 is inverted as shown in FIG. 4. The first upper pivot pins 21 of the first link member 20 are then inserted into first pivot holders 11 of the cap 10 as shown in FIG. 5. The central pivots 32 of the second link member 30 are fit into the central bores 22 of the first link member 20 and the second upper pivot pins 33 of the second link member 30 are inserted into the second pivot holders 12 of the cap 10 as shown in FIG. 6. The reduced top section 51 of the cone 50 is fit through the central passage 36 of the second link member 30 and inserted into the recess 16 of the cap 10 thereby forming a subassembly of the push button as shown in FIG. 7. Thereafter, in FIG. 8, the circuit 60 is positioned on the subassembly of the FIG. 7. In FIG. 9, the base 40 is positioned on the circuit 60. In FIG. 10, the first lower pivot pins 24 of the first link member 20 and the second lower pivot pins 31 of the second link member 30 respectively engage with the third and fourth pivot holders 43, 41 of the base 40. Finally, in FIG. 11, the push button so assembled is inverted to normal orientation completing the assembly process.

Although the present invention has been described with respect to the preferred embodiment, it is contemplated that a variety of modifications, variations and substitutions may be done without departing from the scope of the present invention that is intended to be defined by the appended claims.

What is claimed is:

1. A push button structure comprising:

a cap forming two first pivot holders defining two aligned first bores and two second pivot holders defining two aligned second bores spaced from the first bores, the cap also forming a recess;

a base plate positioned under the cap and spaced therefrom, the base forming two third pivot holders defining two aligned third bores and two fourth pivot holders defining two aligned fourth bores, the third bores being spaced from the fourth bores;

a resilient member arranged between the base plate and the cap with a reduced section thereof received and retained in the recess of the cap; and first and second link members each having an upper section and a lower section connected to each other by at least one connecting section, the connecting section of the second link member forming a central pivot rotatably received in a central bore defined in the connecting section of the first link member thereby pivotally attaching the first link member to the second link member, the upper sections of the first and second link members forming two first upper pivot pins and two second upper pivot pins rotatably received in the first and second bores of the first and second pivot holders of the cap and the bottom sections of the first and second link members forming two first lower pivot pins and two second lower pivot pins rotatably received in the third and fourth bores of the third and fourth pivot holders of the base plate for movably supporting the cap above the base plate;

wherein each bore of the first, second, third and fourth pivot holders has an inclination for guiding and facilitating insertion of the pivots into the corresponding bores thereby enhancing assembly of the push button.

2. The push button structure as claimed in claim 1, wherein the central bore of the firs link member has a diverging side opening for guiding and facilitating insertion of the central pivot of the second link member therein.

3. The push button structure as claimed in claim 1, wherein each first pivot holder comprises two spaced bars extending from the cap with the first bore defined therebetween, each bar having an inclined face opposing each other for guiding and facilitating the first upper pivot pin into the first bore.

4. The push button structure as claimed in claim 3, wherein each bar defines a recess opposing each other for forming the first bore thereof.

5. The push button structure as claimed in claim 1, wherein each second pivot holder comprises two spaced walls extending from the cap defining a gap therebetween serving as the second bore for accommodating the corresponding second upper pivot pin, each wall forming an inclined face for guiding and facilitating insertion of the second upper pivot pin into the gap.

6. The push button structure as claimed in claim 1, wherein each third pivot holder comprises an L-shaped tab extending from the base plate defining a recess serving as the third bore for accommodating the first lower pivot pin, an inclination being formed on the L-shaped tab for guiding and facilitating insertion of the first lower pivot pin into the third bore.

7. The push button structure as claimed in claim 6, wherein the L-shaped tab is stamped on the base plate.

8. The push button structure as claimed in claim 1, wherein each fourth pivot holder comprises two tabs extending from the base plate, the tabs being spaced from each other to define the fourth bore, a neck being formed between the tabs for retaining the second lower pivot pin in the fourth bore, each tab having an inclined edge for guiding and facilitating insertion of the second lower pivot into the fourth bore.

9. The push button structure as claimed in claim 8, wherein the tabs are stamped on the base plate.

10. The push button structure as claimed in claim 1, wherein the upper section and lower section of each link member are connected by the connecting section to form a U-shape.

11. The push button structure as claimed in claim 1, wherein the upper section and lower section of each link member are connected by two connecting sections to form a rectangular frame.

* * * * *